US005564826A

United States Patent [19]

Neumann et al.

[11] Patent Number: 5,564,826

[45] Date of Patent: Oct. 15, 1996

[54] RECIPROCATING BATH SHAKER

[75] Inventors: Hans D. Neumann, Los Altos; Arthur J. Robbins, Mountain View; David J. Wright, Fremont, all of Calif.

[73] Assignee: Robbins Scientific Corporation, Sunnyvale, Calif.

[21] Appl. No.: 534,578

[22] Filed: Sep. 27, 1995

[51] Int. Cl.[6] ..... B01F 11/00

[52] U.S. Cl. ..... 366/219; 366/215; 366/146

[58] Field of Search ..... 366/219, 240, 366/208, 209, 210, 211, 212, 215, 144, 146, 149

[56] References Cited

U.S. PATENT DOCUMENTS

| | | | |
|---|---|---|---|
| 3,688,684 | 9/1972 | Piedallu | 366/240 |
| 4,109,319 | 8/1978 | Brandt | 366/219 |
| 4,673,297 | 6/1987 | Siezek | 366/208 |
| 4,750,845 | 6/1988 | Nabetani | 366/208 |

*Primary Examiner*—Robert W. Jenkins
*Attorney, Agent, or Firm*—Michael J. Hughes; Mark E. Baze

[57] ABSTRACT

A bath shaker (10) is provided for agitating liquid baths. The bath shaker (10) incorporates a "flexible parallelogram" mode of movement wherein a bath shelf (20) is attached to and supported by two, parallel opposing flexible arms (112). Present on each flexible arm (112) is a first attachment portion (124) sandwichedly held by an upright extension (120) and a first hold plate (110), the arrangement causing the first attachment portion (124) to serve as a flexible hinge. A drive mechanism (16) produces a reciprocating action of the bath shelf (20) through the use of an eccentric (80) and a pivoting lever (46) attached to both the eccentric (80) and the bath shelf (20). The flexible parallelogram arrangement defines the reciprocating motion to be substantially rectilinear and makes for an entirely noiseless mode of travel, while producing an extremely smooth transition between reciprocations. Two bath containers (24) are supported by the bath shelf (20) and are provided with a highly accurate temperature control system (26).

19 Claims, 8 Drawing Sheets

RECIPROCATING BATH SHAKER

TECHNICAL FIELD

The present invention relates generally to machines for shaking, agitating and mixing, and more particularly to machines for agitating liquid baths and substance-containing vessels.

BACKGROUND ART

In testing and research carded out in chemical and biological laboratories and in the field, it is routine that substances will require mixing, or that agitation of some form or another will be necessary to promote a reaction or development time for a synthesis or a culturing or testing procedure. A variety of devices exist to carry out such agitation for extended periods of time. To be distinguished from devices such as magnetic and mechanical stirrers, which perform an agitating action directly on the substance or substances to be mixed or shaken, are shaking machines that employ a moving platform or shelf upon which is placed a plurality of vessels such as beakers and Erlenmeyer flasks. Movement of the shelf by an attached drive mechanism causes a corresponding agitation of the vessels and of any contents held therein. Such movement, depending on the drive mechanism of the shaking machine, is generally of a reciprocating or gyrating nature. While for some applications the type of agitation may be of little or no importance, for others, a completely successful result may only be achievable with an agitation motion that is of a certain type, that is, agitation by either a reciprocal or gyratal action, and/or agitation of a gentle or strong nature.

It is equally routine that, during such agitation, it will be required that a controlled temperature environment be maintained. In the case of shaking machines, such temperature control is usually carried out by immersing the substance-containing vessels, or a testing component, in a bath, the bath being supported by, or an integral part of, the moving shelf. The bath is typically a liquid bath of water; less frequently it is one of an oil or an organic solvent. A heating or cooling element connected to a temperature controller is generally used to maintain the desired temperature, the element either being immersed in the bath or in close external proximity thereto. Many applications, especially those relating to modern molecular biology and biochemistry, require an especially narrow temperature window, only within the limits of which is it possible to obtain satisfactory results.

Most of the bath shaking machines as are presently available are either noisy in operation, or are incapable of a gentle agitation motion, or both. They frequently do not allow for a narrow temperature control. Many bath shakers are bulky and heavy as well. U.S. Pat. No. 5,052,812, issued to Tannenbaum, et al., on Oct. 1, 1991, notes some of these problems while citing a comprehensive listing of relevant patents and commercial sources of conventional bath shakers. Typically, reciprocating bath shakers employ a rail or guide system that is inherently noisy due to travel by a sliding or rolling component along the rail or guide. Rail mechanisms, if precise and quiet, also tend to be very expensive, due to tolerance requirements. And gyrating bath shakers, whether noisy or otherwise, do not produce a motion that is desirable for many types of sensitive analysis and testing procedures. Because of the limitations associated with most presently available bath shakers, a substantial need still exists for a bath shaker that is quiet in operation, that takes up a minimal amount of space, and that is capable of producing an agitation motion and control of temperature environment that is compatible with modem testing procedures.

DISCLOSURE OF THE INVENTION

Accordingly, it is an object of the present invention to provide a bath shaker that has a smooth and quiet operation.

It is another object of the invention to provide a bath shaker that can produce an agitation motion from very gentle to very vigorous.

It is a further object to provide a bath shaker that is capable of precise temperature control.

It is yet another object to provide a bath shaker that occupies a minimum of bench area.

It is yet a further object to provide a bath shaker that is easy to use and has a simplicity of construction and instrumentation.

It is still another object to provide a bath shaker that provides for easy access to the bath(s) for placement and removal of test components.

It is a still further object to provide a bath shaker wherein all mechanical workings are isolated from the water bath(s).

It is yet another object of the present invention to provide a bath shaker that is relatively inexpensive.

Briefly, the preferred embodiment of the present invention is a bath shaker for agitating liquid baths. The bath shaker incorporates a "flexible parallelogram" mode of movement wherein a bath shelf is attached to two, parallel opposing flexible arms. A drive mechanism produces a reciprocating action of the bath shelf through use of an eccentric, and a pivoting lever attached to the eccentric and the bath shelf. The flexible parallelogram arrangement defines the reciprocating motion to be substantially rectilinear. The bath shelf is supported by the flexible arms, with supplemental support provided by a Teflon™ block (or alternatively a roller wheel arrangement) for heavy loads or to prevent shock during transport. The flexible parallelogram design makes for an entirely noiseless mode of travel and also produces an extremely smooth transition between reciprocations. Two bath containers are supported by the bath shelf and are provided with a highly accurate temperature control system that utilizes heater pads attached to the underside of the bath containers.

An advantage of the present invention is that the movement of the bath shaker is entirely noiseless (the only detectable sound originates from a quiet electric drive motor) and therefore is not disruptive to operators during extended periods of use.

Another advantage of the invention is that the bath shaker produces a gently undulating motion that is suitable for sensitive molecular biological testing such as nucleic acid hybridizations and recombinant DNA technology.

A further advantage is that the bath shaker provides for a precise and uniform heating of the bath(s).

Yet another advantage is that the bath shaker takes up only a fraction of the bench space occupied by conventional shaking waterbaths.

Yet a further advantage is that operation of the bath shaker requires an extremely minimal learning curve.

Still another advantage is that the simple and efficient design of the bath shaker make it easy to clean, maintain and repair.

A still further advantage is that the efficient design of the bath shaker makes it light in weight and therefore easily transportable.

Yet another advantage is that the bath shaker operates with little or no adverse splashing at high speeds and during startup.

Yet a further advantage of the present invention is that corrosion of mechanical pans is unlikely because the drive mechanism is completely isolated from the water baths.

These and other objects and advantages of the present invention will become clear to those skilled in the art in view of the description of the best presently known mode of carrying out the invention as described herein and as illustrated in the several figures of the drawings.

BEST MODE FOR CARRYING OUT THE INVENTION

Figure 1:
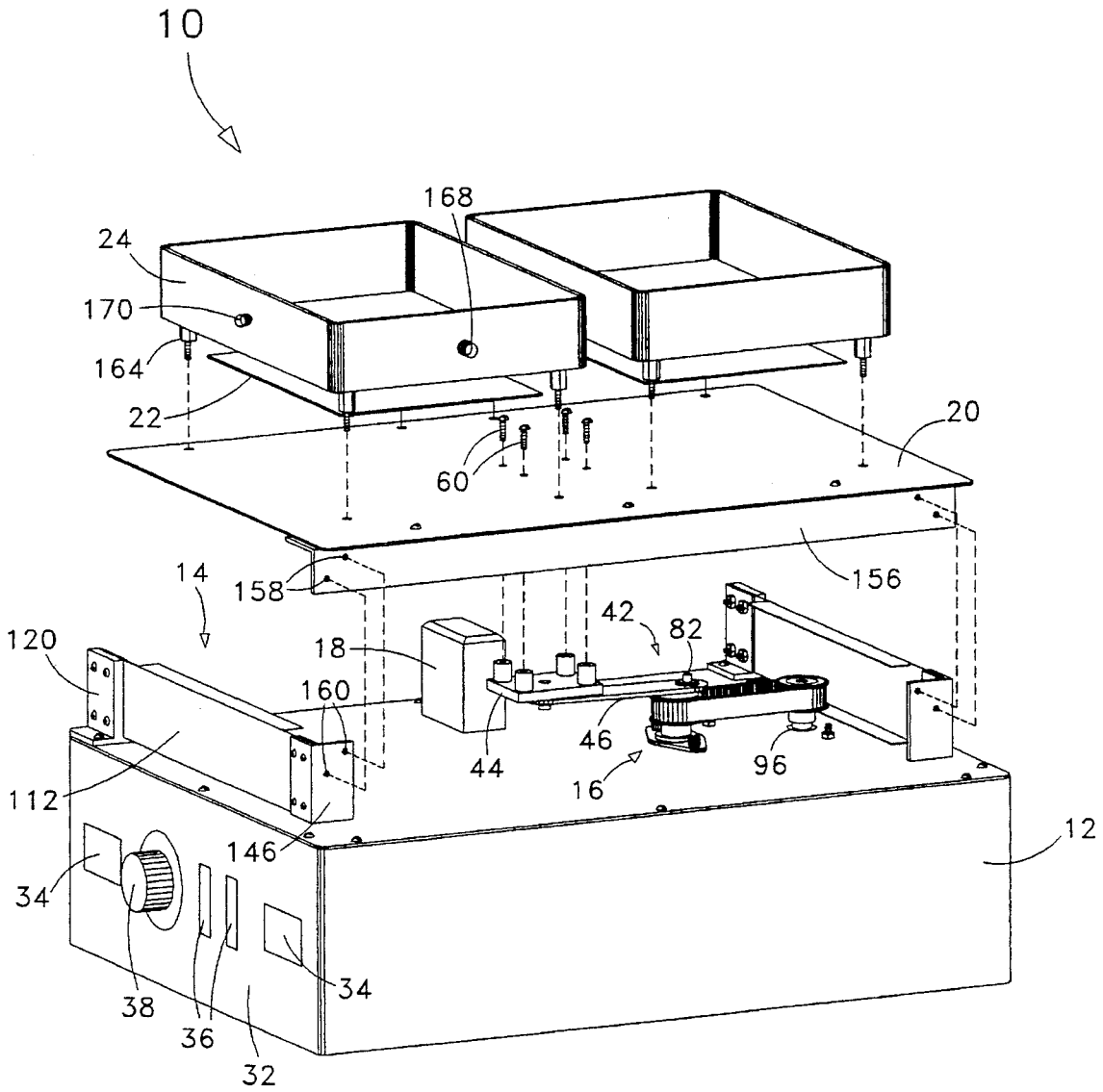
FIG. 1 is an exploded perspective view of the preferred embodiment of the present invention.

The preferred embodiment of the present invention is a bath shaker for agitating baths and substance-filled containers. The bath shaker of the preferred embodiment is primarily directed toward research and testing as would be done in the field of molecular biology, such as DNA analysis, and is set forth in FIGS. 1 and 2, where it is designated therein by the general reference character 10.

Figure 2:
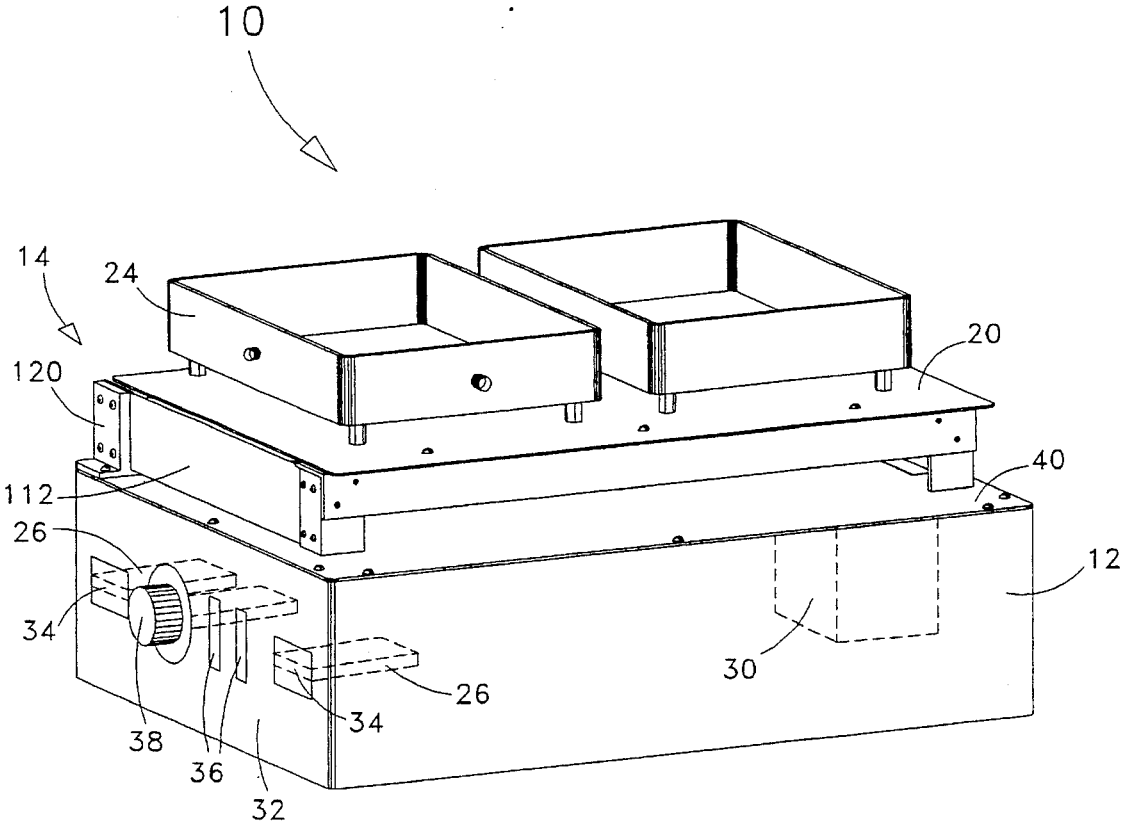
FIG. 2 is a perspective view of the assembled preferred embodiment (with internal components of the base unit being shown with dashed lines)

Referring to the exploded view in FIG. 1 of the drawings, the bath shaker 10 is shown to include a base unit 12, two arm assemblies 14, a drive mechanism 16, a support block 18, a bath shelf 20, two heater pads 22, and two bath containers 24. The base unit 12 primarily houses two identical electronic temperature control systems 26, an electronic agitation control system 28, and an electric drive motor 30 (FIG. 2). The front face 32 of the base unit 12 includes two temperature control panels 34, two on-off switches 36, and a variable speed control knob 38 for adjusting the reciprocation rate of the bath shaker 10. The base unit 12 is covered by a cover plate 40.

Figure 3:
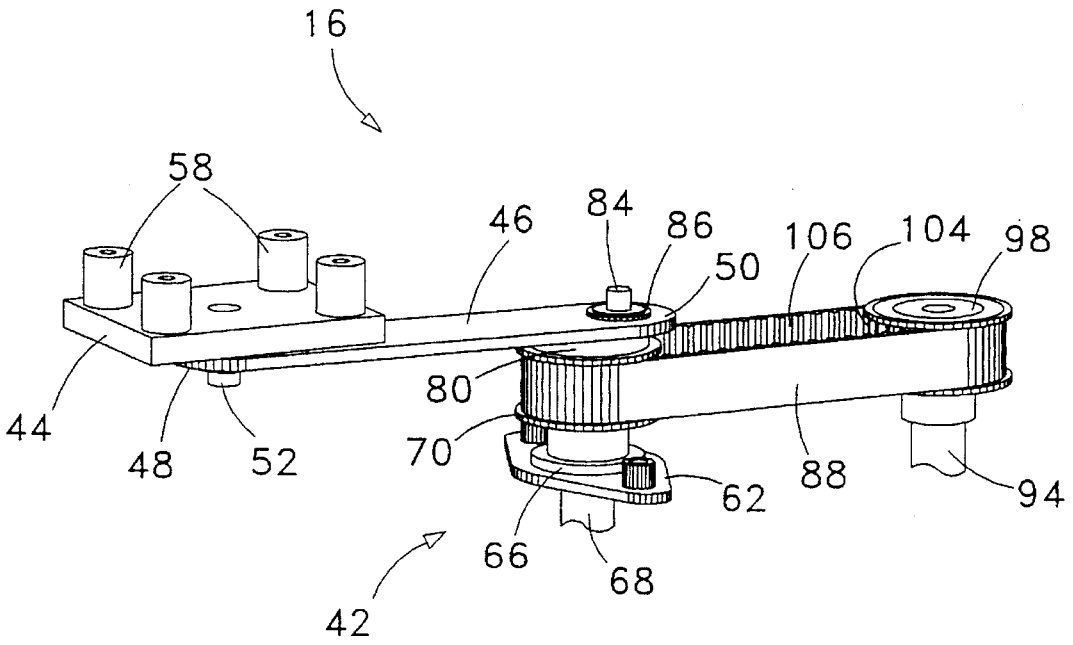
FIG. 3 is a perspective view of the drive mechanism.
Figure 4:
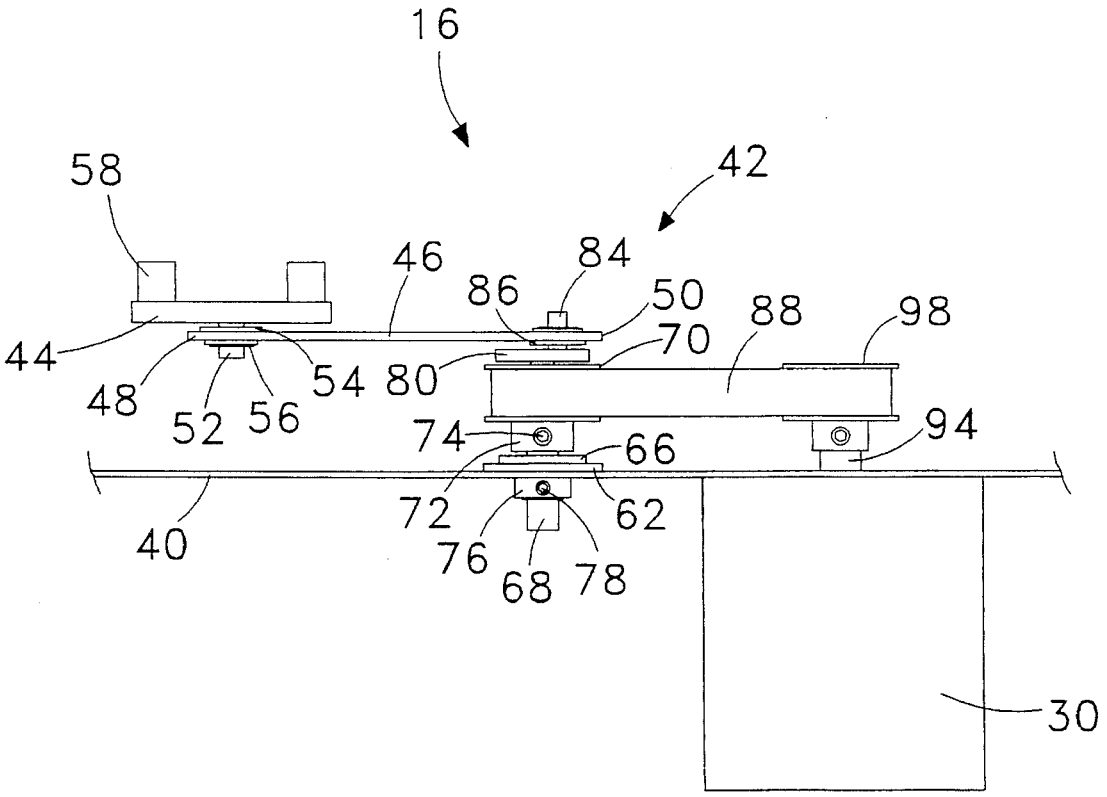
FIG. 4 is a side view of the drive mechanism and electric drive motor.

The drive mechanism 16 of the bath shaker 10 is detailed in FIGS. 3 and 4. An eccentric assembly 42 is employed in conjunction with a pivoting carrier table 44 to convert a pure rotational motion of the electric drive motor 30 into a reciprocating, substantially rectilinear motion of the bath shelf 20. The eccentric assembly 42 is linked to the carder table 44 by way of a lever 46, which pivots at both a lever proximal end 48 and a lever distal end 50. A table pin 52 and a first lever bearing 54 provide the connection between the carrier table 44 and the lever 46. The table pin 52 is press-fitted into the center of the carrier table 44 and is rotatably mounted in the first lever bearing 54, which is located at the lever proximal end 48. The table pin 52 is rotatably retained within the first lever bearing 54 by a retaining ring 56. (Not shown in the drawings is that, in conventional fashion, the lower end of the table pin 44 is provided with an annular groove and/or is enlarged to hold the retaining ring 56 in place.) The lever 46 and the carrier table 44 are thus free to pivot at the lever proximal end 48. The carder table 44 provides support for four upwardly extending and internally threaded shelf mounts 58 to which is attached the bath shelf 20. The shelf mounts 58 are simply stationary nuts incorporated into the carder table 44 and into which screws 60 (FIG. 1) are threaded for holding the bath shelf 20. The precise design of the carder table 44 and of the shelf mounts 58 is unimportant, the function of the carder table 44 and the shelf mounts 58 simply being to provide a pivotal interface between the bath shelf 20 and the lever 46. The carder table 44 and shelf mounts 58 may even be eliminated entirely, with the bath shelf 20 itself incorporating an equivalent of the table pin 44, to which could be directly attached the lever 46.

Continuing to refer to FIGS. 3 and 4, the eccentric assembly 42 is shown to include a stationary mounting bracket 62 that is attached to the cover plate 40 with a bolt and nut arrangement or similar type of fastener. The mounting bracket 62 contains a mounting beating 66 that is aligned with an opening present in the cover plate 40. A shaft 68, rotatably mounted in the mounting bearing 66, extends both downwardly through the cover plate 40 and upwardly into a first pulley 70. The first pulley 70 receives the shaft 68 by way of an integral collar 72. The integral collar 72 is provided with a set screw 74 with which the first pulley 70 is tightened upon the shaft 68. A collar 76, also having a set screw 78, similarly receives the shaft 68 below the cover plate 40 and thereby rotatably retains the shaft 68 to the base unit 12. Attached to the top of the first pulley 70 is an eccentric 80 having an in-line pin 82 that extends downwardly from the center of the eccentric 80. The in-line pin 82 is press fitted into the top of the first pulley 70 and is in axial alignment with the shaft 68. An offset pin 84 extends upwardly from the eccentric 80 and, as implied by the reference name, is positioned at a location radially distant from the center of the eccentric 80. Rotatably mounted on the offset pin 84 is the lever distal end 50. The offset pin 84 is retained within a second lever bearing 86 in a manner essentially identical to that used to retain the table pin 52, again, so that the lever distal end 50 is free to pivot. The degree of eccentricity of the offset pin 84 determines the range of motion produced by the eccentric assembly 42 and thus the distance traveled by the bath shelf 20 during each reciprocation.

Still referring to FIGS. 3 and 4, rotational energy to turn the eccentric 80 is transmitted to the first pulley 70 from the electric drive motor 30 via a drive belt 88. The electric drive motor 30 is mounted in an inverse manner on the underside of the cover plate 40 using a conventional fastening method. A drive shaft 94 arises directly from the electric drive motor 30 and extends upwardly through an aperture 96 (FIG. 1) in the cover plate 40 and into a second pulley 98. The second pulley 98 is essentially identical to the first pulley 70, having an integral collar 100 with a set screw 102 that is used to secure the second pulley 98 onto the drive shaft 94. Both of the first and second pulleys (70 and 98) have vertical ridges 104 that mate with teeth 106 on the drive belt 88, which help insure a solid engagement of the drive belt 88 and a correspondingly steady reciprocal drive action by the drive mechanism 16. It should be noted that such a second pulley 98 is not in fact required to convert the output rotation of the drive motor 30 into the reciprocating motion of the bath shelf 20. The second pulley is primarily used to reduce fatigue to the components of the drive motor 30.

While in the preferred embodiment of the bath shaker 10, the drive mechanism 16 is described as being attached to the bath shelf 20, it would be apparent to those with skill in the art that the drive mechanism 16 could also be directly attached to one or both of the arm assemblies 14 to produce the reciprocating movement of the bath shelf 20. Similarly, the drive mechanism 16 need not be located under the bath shelf 20. The drive mechanism 16 could be located to any side of the bath shelf 20 and/or arm assemblies 1,4, or even overhead.

Figure 5:
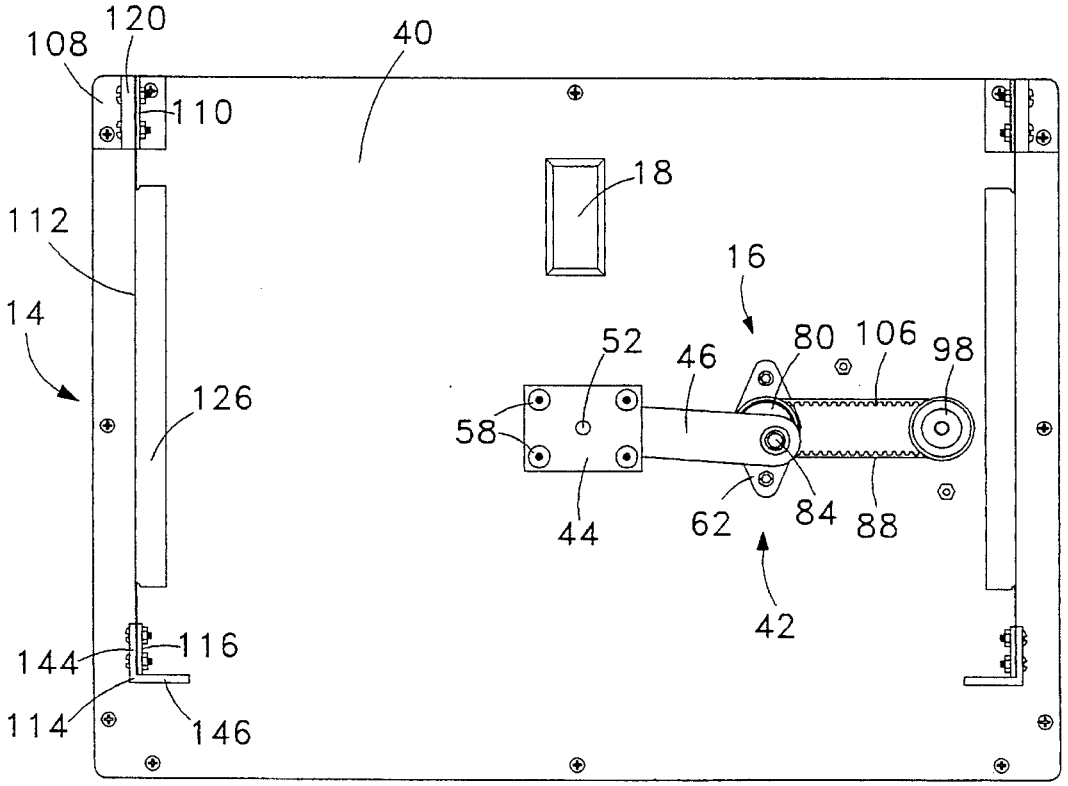
FIG. 5 is a is a top plan view of the preferred embodiment with the bath shelf and baths removed.
Figure 6:
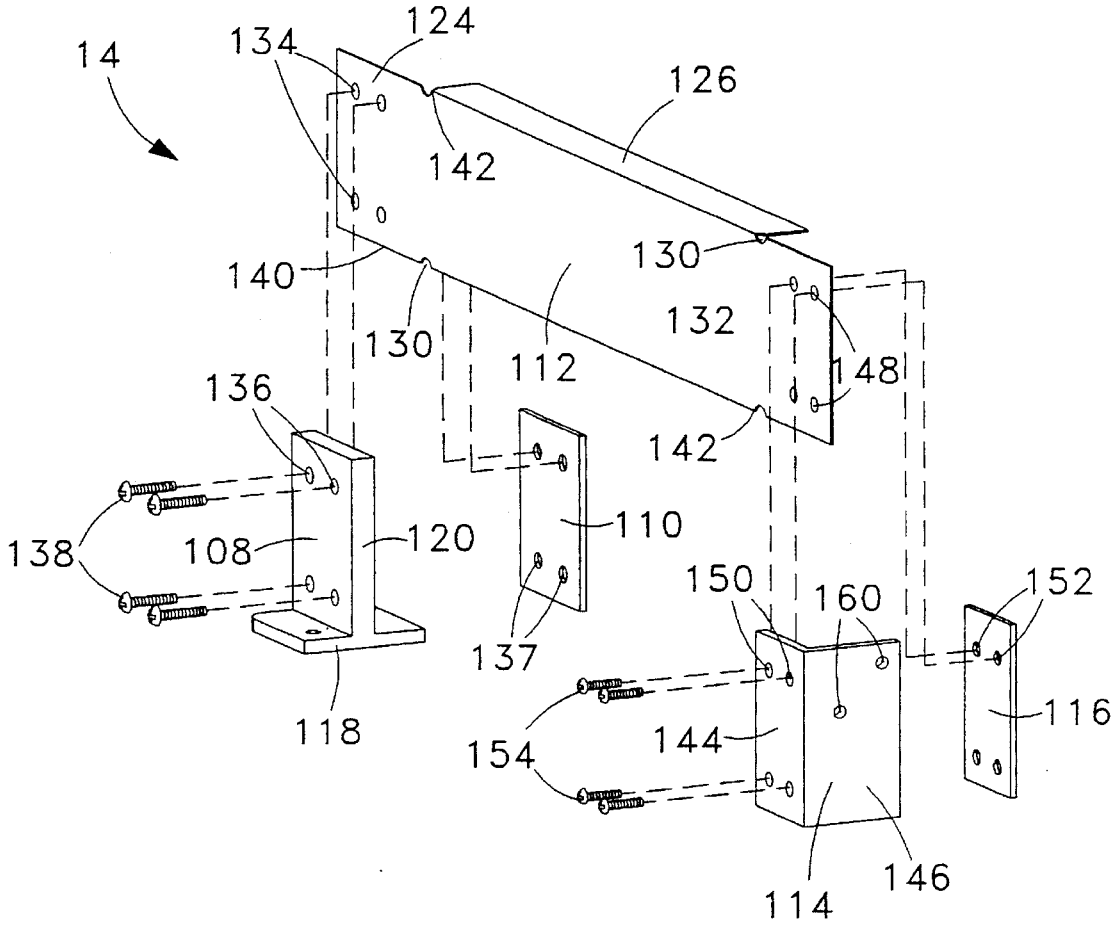
FIG. 6 is an exploded perspective view of the arm assembly.
Figure 7:
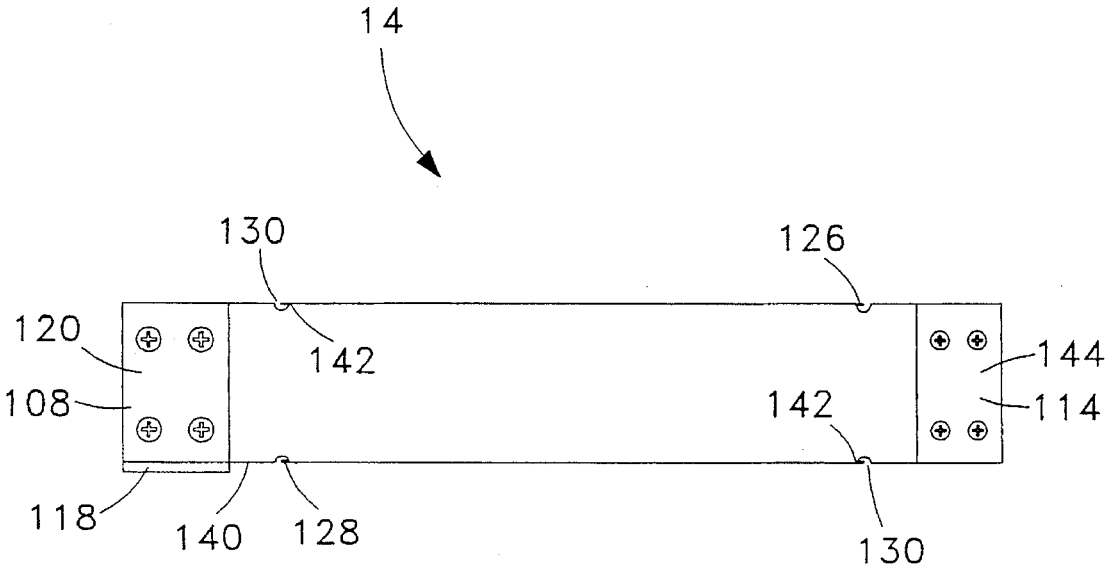
FIG. 7 is a side view of the arm assembly.

Referring now to FIGS. 1 and 5, unique to the present are the two arm assemblies 14 which are located at the front and rear of the bath shaker 10 and which are used to support and carry the bath shelf 20 in a resilient and noiseless fashion. The two arm assemblies 14 are mirror images of one another, and are mounted in parallel, opposing fashion. Referring now in more detail to FIGS. 6 and 7, each arm assembly 14 includes a support bracket 108, a first hold plate 110, a flexible arm 112, a shelf bracket 114, and a second hold plate 116. The support bracket 108 has a generally upside-down solid T-shape with a bracket base 118 and an upright extension 120. The support bracket 108 is attached by the bracket base 118 to the cover plate 40 with screws (FIGS. 1 and 5). The first hold plate 110 has a shape that matches that of the upright extension 120 and is bolted onto the upright extension 120 in order to hold the flexible arm 112 therebetween. This attachment, as will be described, is such as to allow the flexible arm 112 to function in a resilient, spring-like capacity.

Continuing to refer to FIGS. 6 and 7, each flexible arm 112 has a generally elongated rectangular shape, is formed from sheet metal, and includes a first attachment portion 124, an upper reinforcement 126, a lower reinforcement 128, stress relief notches 130, and a second attachment portion 132. The first attachment portion 124 has bolt-receiving holes 134 that align with bolt-receiving holes (136 and 137) present in the upright extension 120 and in the first hold plate 110, and through which small bolts 138 are passed to sandwich the first attachment portion 124 between the upright extension 120 and the first hold plate 110. Anchored in this manner, the flexible arm 112 is permitted to springingly reciprocate back and forth in a front-to-back direction as relative to the base unit 12. Thus, the first (and second) attachment portion 124 serves as a flexible hinge. A lower edge 140 of the first attachment portion 124 rests on the bracket base 118 permitting the flexible arm 112 to swing sufficiently high above the cover plate 40 to avoid contact therewith.

The upper and lower reinforcements (126 and 128) are simply integral "flap" extensions of sheet metal that have been folded over at junctures 142 and made to be perpendicular to the flexible arm 112. The upper and lower reinforcements (126 and 128) have a generally rectangular shape with a length less than the overall length of the flexible arm 112. The upper and lower reinforcements (126 and 128) increase the strength of the flexible arm 112, making the flexible arm 112 quite rigid and dramatically increasing the resistance of the flexible arm 112 to bending.

The stress relief notches 130 are located at the junctures 142 and help to prevent a premature failure (i.e., cracking) of the flexible arm 112 by redistributing stress that would otherwise tend to accumulate at a sharp-edged juncture, such junctures being prone to failure due to the redundant reciprocations that the flexible arms 112 are subjected to. The stress relief notches 130 are also intended to reduce stresses that may be created during the fabrication process itself. The stress relief notches 130 are small circular holes that are cut prior to the bending and creation of the upper and lower reinforcements (126 and 128). This method of reducing localized stress is conventional and well known in the art of sheet metal working.

The flexible arm 112 is preferably made of stainless steel, both to increase resistance to stress failure, and also to provide corrosion resistance from the various chemicals that are typically encountered in a laboratory setting, and which might otherwise cause deterioration of the flexible arm 112. It is predicted that the use of stainless steel sheet metal of a 26 gauge thickness, and the incorporation of the stress relief notches 130, will allow the flexible arms 112 (or more precisely, the first attachment portions 124 thereof) to endure many millions of bending cycles/reciprocations prior to failure, since the amount of bending deflection and the shear loads are limited, thus providing for an essentially infinite endurance.

The construction and perpendicular orientation of the flexible arms 112 to the bath shelf 20 are such so as to incorporate the width of the sheet metal in a strength capacity for supporting the bath shelf 20, while incorporating the resilience created by the thickness and length of the sheet metal in a spring-like capacity to provide a smooth and noiseless motion. It would be apparent to those with ordinary skill in the art that a similar resilient motion could be achieved with an arm assembly 14 that incorporates a spring of a different nature. For example, an entirely rigid arm could be employed with a spring (or springs) located at the base of the arm or within an arm mounting (i.e., to take the place of the first attachment portion 124).

Still referring to FIGS. 6 and 7, the second attachment portion 132 of the arm assembly 14 is essentially identical to the first attachment portion 124, the only difference being that the second attachment portion 132 is connected to the shelf bracket 114 and to the second hold plate 116. The shelf bracket 114 has a generally solid L-shape with a front extension 144 and a side extension 146. Similarly to the first attachment portion 124, the second attachment portion 132 has bolt-receiving holes 148 in alignment with bolt-receiving holes (150 and 152) in the front extension 144 and in the second hold plate 116, and through which small bolts 154 are passed to sandwich the second attachment portion 132 between the front extension 144 and the second hold plate 116. The shelf bracket 114 (and second hold plate 116) provides a reinforced area for attachment of the bath shelf 20 to the flexible arm 111.

Figure 8:
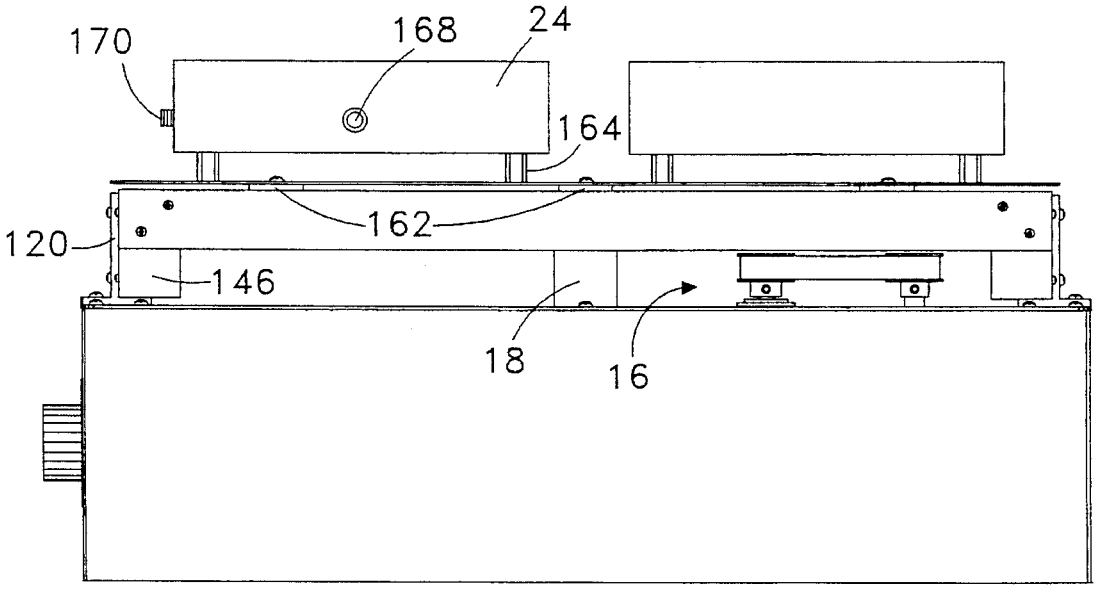
FIG. 8 is a side elevational view of the preferred embodiment.

Referring again to FIG. 1, and also to the side elevational view of FIG. 8, the bath shelf 20 is attached to the side extension 146 of the shelf bracket 114 via a flange 156. The flange 156 provides a site of attachment for the bath shelf 20 to the arm assemblies 14 and also gives increased rigidity to the bath shelf 20. The flange 156 has a generally solid L-shape and runs the length of the bath shelf 20. As best shown in FIG. 8, the attachment of the flange 156 is such that the bath shelf 20 rides slightly above the upright extensions 120 and flexible arms 112 (and the support block 18) and is thus not interfered with thereby. This clearance may be accomplished either by the alignment of bolt receiving holes (158 and 160) in the flange 156 and the side extension 146 (FIG. 1), or with a spacer(s) of some form inserted between the flange 156 and the bath shelf 20. In the preferred embodiment, spacers 162 are used to lift the bath shelf 20 to the desired elevated height. The spacers 162 are simply notched flanges of metal interposed between the flange 156 and the bath shelf 20, and which extend toward the opposing side of the bath shaker 10 along the underside of the bath shelf 20. The spacers 162, like the flange 156, serve a dual function by also increasing the rigidity of the bath shelf 20. Flange 156 could, of course, be made to be an integral extension of the shelf bath 20, and a number of other variations of attaching the bath shelf 20 to the flexible arms 112 would be apparent to one with ordinary skill in the art.

Referring to FIG. 1, the bath shelf 20 itself is generally rectangular and in preferred form is made of aluminum sheet metal with a protective anodized finish. The bath shelf 20 is carried by the flexible arms 112 and is supplementarily supported by the support block 18, which is located on the side of the bath shelf 20 opposite the flange 156. The support block 18 is made of Teflon™ and provides auxiliary support to prevent damage to the flexible arms 112 in situations in which the bath shaker 10 might be subject to heavy work loads or to outside forces such as a person leaning on top of the bath shaker 10 or shocks encountered during transport. Alternatively, and especially in situations in which the bath shaker 10 might be subject to routinely heavy work loads, a roller-beating wheel type arrangement (not shown) may be provided, which would be adjusted so as not to contact the bath shelf 20 except in a supplementary, supporting capacity during such heavy use.

Continuing to refer to FIG. 1 (and to FIGS. 3 and 4), as noted previously, the bath shelf 20 is attached to the carder table 44. The motion of the bath shelf 20 follows the motion of the carder table 44 as constrained by the attachment of the bath shelf 20 to the flexible arms 112. In combination, the flexible arms 112 and the flange 156/bath shelf 20 create what may be considered to be a "flexible parallelogram." This flexible parallelogram geometry requires that the bath shelf 20 follow a path that is substantially rectilinear, at least over the short distance of motion produced by the eccentric assembly 42. The eccentric assembly 42 produces a reciprocating motion as the offset pin 82 travels in a circular orbit which alternately moves the offset pin 82 from a position closer to the rear of the bath shaker 10 to a position closer to the front of the bath shaker 10, and then back again. The eccentric 78 of the preferred embodiment provides a reciprocating motion or stroke (excursion) of approximately 1.3 cm (0.5 in). The lever 46, being attached to the offset pin 82, is corresponding alternately pushed and pulled, and by virtue of the pivotal attachments at both the lever proximal and distal ends (48 and 50), is able to cause the bath shelf 20 to reciprocate along the line of motion defined by the flexible parallelogram. The movement of the flexible arms 112 (and of the attached bath shelf 20) is completely noiseless, unlike systems employing a track or rail or similar guide structure. The spring-like nature of the flexible arms 112 also makes for a very smooth transition between reciprocations, thus reducing the potential for splashing. It should be noted that the present invention is not limited to having flexible arms 112 that are of an identical length as is depicted in the drawings. Useful and interesting movement patterns for specialized applications may be generated by incorporating arms that are of a dissimilar or variable length.

Still referring to FIG. 1, and to FIG. 8 as well, the two bath containers 24 are supported by the bath shelf 20. The bath containers 24 are attached to the bath shelf 20 with spacer bolts 164. The spacer bolts 164 are commercially available bolts that incorporate a built-in, hexagonally shaped spacer portion. One end of the spacer bolts 164 is threaded into threaded holes (not shown) on the underside of the bath containers 24, the other end being received by bolt receiving holes 166 in the bath shelf 20. The preferred bath containers 24 are machined from a solid block of aluminum ahoy, although sheet metal and cast aluminum, and other materials, may be used as well. Each bath container 24 includes a first port 168 and a second port 170. The first and second ports (168 and 170) may be employed with a temperature probe and a calibration thermometer, using conventional ferrule and bushing fasteners. A fitted clear, plastic cover (not shown) may also be used to cover the bath container 24 to impede water evaporation and to assist in temperature maintenance.

Although two, relatively small bath containers 24 are employed in the preferred embodiment of the bath shaker 10 (the bath containers 24 being directed to sensitive DNA testing on small test components), it is intended that the bath shaker 10 of the present invention, as incorporates the flexible parallelogram mode of operation, also be used for larger scale work. For such larger scale work, Erlenmeyer flasks or other substance-filled containers would be agitated in a single, large bath container which would be equipped with heat control equipment in a similar manner to the small, dual bath containers 24.

As shown in the exploded view of FIG. 1, attached to the bottom of each bath container 24 is a heater pad 22. The heater pad 22 is a commercially available product in the form of a thin pad made of fiberglass-reinforced silicone rubber with a wire-wound or etched foil element. The heater pad 22 covers substantially the entire bottom underside surface of the bath container 24 and is attached to the bath container 24 with an adhesive. The construction and material of the bath container 24 are so as to be able take advantage of the exceptional performance capabilities of this type of heater, which provides for a rapid and efficient transfer of heat. The heater pads 22 are regulated by the temperature control systems 26, which are commercially available microprocessor-based controllers. (The temperature control panel 34 is included with the temperature control system 26 in commercially available packages.) The temperature control system 26 has the capability to be calibrated using a calibration thermometer reading as reference. The temperature control system 26 also has a timer function so that the bath shaker 10 may be left unattended and the heat mined off (and/or on) at a predetermined time.

In addition to the above mentioned examples, it is to be understood that various other modifications and alterations with regard to the types of materials used, their method of joining and attachment, and the shapes, dimensions and orientations of the components as described may be made without departing from the invention. Accordingly, the above disclosure is not to be considered as limiting and the appended claims are to interpreted as encompassing the entire spirit and scope of the invention.

INDUSTRIAL APPLICABILITY

The bath shaker 10 of the present invention is designed to be used for any chemical or biological application requiring reciprocal shaking motion under controlled temperature conditions. Typical applications of the preferred embodiment include hybridizations, filter washes, electrophoretic gel manipulation, hot staining protocols, recombinate DNA methods, and tissue, metabolic, enzymatic and cell studies. Use of the bath shaker 10 is simple. After filling the bath containers 24 with water, the desired temperature and time settings are entered via the temperature control panel 34. If a precise temperature or range of temperature is needed, calibration with an accurate calibration thermometer may be performed. The test samples, e.g., membrane strips for hybridization and DNA typing, are then placed in the bath containers 24 and the agitation rate of the bath shaker 10 is adjusted with the speed control knob 38. The bath shaker 10 may be set to be either automatically or manually turned off when desired.

The bath shaker operates 10 quietly and efficiently. The simplicity of operation of the bath shaker 10 frees the operator to perform other duties. The extremely quiet nature of the flexible parallelogram design of the bath shaker 10 means that the bath shaker 10 does not act as a source of distracting noise. Neither does the bath shaker 10 make any additional contribution to what may already be an uncomfortable noise level, many scientific laboratories having a plethora of mechanized apparatus (e.g., fume hoods and vacuum pumps) that may be in simultaneous operation. For these reasons and numerous others as set forth previously herein, it is expected that the industrial applicability and commercial utility of the present invention will be extensive and long lasting.

What is claimed is:

1. A bath shaker comprising:

two resilient arms arranged in substantially parallel fashion, each of said arms having a first end and a second end, each said arm including being formed of a sheet metal, the sheet metal being substantially rectangular and having a length, a width, and a thickness, the length being substantially greater than the width, the thickness being of a resilient gauge;

an anchoring means for anchoring the first end of each said arm;

a shelf supportably attached to the second end of each said arm, the width of the sheet metal being oriented perpendicularly to said shelf;

a bath container mounted on said shelf, said bath container having an underside; and a drive means for reciprocatably moving said shelf between said arms.

2. The bath shaker of claim 1 wherein the sheet metal further includes a foldover extension for structural reinforcement, and a notch for stress relief, the foldover extension and the arm forming a juncture, the notch being located at the juncture.

3. The bath shaker of claim 1 wherein the sheet metal is selected from the group consisting of corrosion resistant materials having good fatigue life properties, including stainless steel.

4. The bath shaker of claim 1 wherein the anchoring means includes a first holding member and a second holding member, and fastening means for fastening the first and second holding members together, the first end of a said arm being sandwiched therebetween.

5. The bath shaker of claim 1 wherein said drive means includes an eccentric and rotating means for rotating the eccentric.

6. The bath shaker of claim 5 further including a lever having a first end and a second end, the first end of the lever being rotatably attached to the eccentric, the second end of the lever being pivotally attached to at least one of said shelf and said arms.

7. The bath shaker of claim 1 further including a heater means for heating water in said bath container.

8. The bath shaker of claim 7 wherein the heater means includes a rubber heating pad attached to the underside of said bath container.

9. The bath shaker of claim 1 further including supplementary support means for said shelf.

10. A bath shaker comprising:

a shelf;

two resilient arm means for attaching to said shelf and for carrying said shelf in a plane so that any point thereon moves as a point in the plane of a flexible and resilient parallelogram having included angles that are continuously and concertedly variable;

a bath container supported by said shelf, said bath container having an underside; and a drive means for reciprocatably moving said shelf.

11. The bath shaker of claim 10 further including the parallelogram having sides that are of a fixed length.

12. The bath shaker of claim 10 further including the parallelogram having one side that is immobile.

13. The bath shaker of claim 10 wherein each said arm means further includes an arm formed of a resilient sheet metal, the sheet metal being substantially rectangular and having a length and a width, the length being substantially greater than the width, the width being oriented perpendicularly to said shelf.

14. The bath shaker of claim 10 wherein said drive means includes an eccentric and rotating means for rotating the eccentric.

15. The bath shaker of claim 14 wherein the heater means includes a rubber heating pad attached to the underside of said bath container.

16. The bath shaker of claim 14 further including a heater means for heating water in said bath container.

17. The bath shaker of claim 10 further including supplementary support means for said shelf.

18. A bath shaker comprising:

a base;

two springingly hinged arms attached to said base, and forming two attachment sites thereby;

a shelf for supporting at least one bath container, said shelf supportably attached to said arms, and forming two mounting sites thereby, said shelf and said arms being in such alignment so as to in combination substantially define the figure of a parallelogram via points located in substantially close proximity to the two attachment sites and the two mounting sites; and a drive means for reciprocatably moving said shelf.

19. The bath shaker of claim 18 wherein each said arm further includes being formed of a sheet metal, the sheet metal being substantially rectangular and having a length, a width, and a thickness, the length being substantially greater than the width, the width being oriented perpendicularly to said shelf, the thickness being of a resilient gauge.

* * * * *